United States Patent [19]

Sorm et al.

[11] Patent Number: 4,646,969

[45] Date of Patent: Mar. 3, 1987

[54] DOUBLE ACTING MECHANICAL PUMP LIQUID ATOMIZER

[75] Inventors: Miloslav Sorm; Jiri Vacha; Karel Ulbert, all of Prague; Frantisek Jagos, Otrokovice; Stanislav Nespurek, Prague; Josef Langpaul, Otrokovice; Stanislav Skalicky, Prague; Jaromir Kensa, Gottwaldov; Miroslav Zvonicek, Prague; Oldrich Drabek, Moravsky Pisek, all of Czechoslovakia

[73] Assignee: Ceskoslovenska Akademie Ved, Prague, Czechoslovakia

[21] Appl. No.: 851,266

[22] Filed: Apr. 10, 1986

Related U.S. Application Data

[63] Continuation of Ser. No. 552,272, Nov. 16, 1983, abandoned.

[30] Foreign Application Priority Data

Nov. 19, 1982 [CS] Czechoslovakia ..... 8302-82

[51] Int. Cl.[4] ..... B05B 15/02; B05B 9/043

[52] U.S. Cl. ..... 239/106; 239/333; 222/375; 222/340; 222/383

[58] Field of Search ..... 239/110, 119, 106, 329–333; 222/321, 375, 109, 110, 340, 383, 318

[56] References Cited

U.S. PATENT DOCUMENTS

| | | | |
|---|---|---|---|
| 1,045,964 | 12/1912 | Friese | 222/110 X |
| 1,947,088 | 2/1934 | Johnson et al. | 222/318 |
| 2,172,136 | 9/1939 | Davis | 222/318 |
| 2,686,562 | 8/1954 | MacCracken et al. | 239/119 |
| 2,753,578 | 7/1956 | Lebet | 222/383 X |
| 2,822,958 | 2/1958 | Merkley | 222/318 X |
| 4,071,172 | 1/1978 | Balogh | 222/321 |
| 4,146,155 | 3/1979 | Kutik et al. | 222/109 |
| 4,305,530 | 12/1981 | Nowaza | 239/333 X |

FOREIGN PATENT DOCUMENTS 2111606 7/1983 United Kingdom .

*Primary Examiner*—Joseph F. Peters, Jr.
*Assistant Examiner*—Kevin Patrick Weldon

[57] ABSTRACT

Double-acting mechanical liquid spraying device having a housing which is adapted to be mounted upon and sealed to the neck of a liquid container, and which has a liquid-containing compartment therein. In the housing, aligned with the liquid-containing compartment, there is an operation cylinder which has an annular valve seat disposed transversely to and intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

4 Claims, 1 Drawing Figure

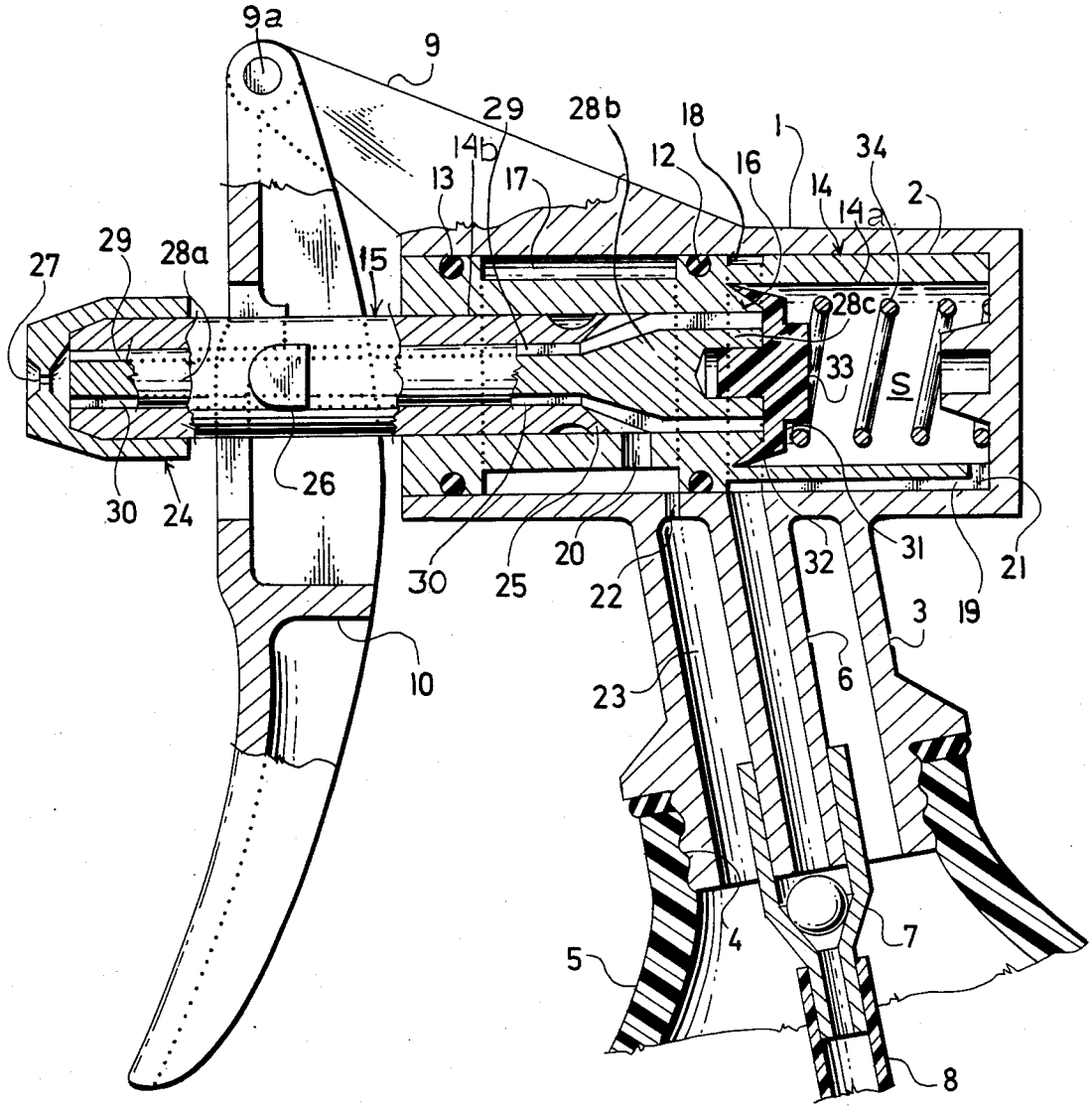
9a
9
29
28b
18
1
34
14b
12
16
14
2
13
17
14a
29
28a
15
27
28c
33
S
26
30
24
30
25
20
22
32
31
21
19
3
10
23
6
4
7
5
8

DOUBLE ACTING MECHANICAL PUMP LIQUID ATOMIZER

This is a continuation of application Ser. No. 552,272, filed Nov. 16, 1983, now abandoned.

This application is related to the co-assigned Sorm et al U.S. application Ser. No. 450,213, filed Dec. 16, 1982 now U.S. Pat. No. 4,503,996.

This invention relates to a double-acting mechanical pump device for the spraying of liquids, such device having an improved connection between a liquid container and the outer atmosphere, and providing for the cleaning of the spray nozzle by blowing through it at the end of the spraying operation. This cleaning of the spray nozzle permits the atomizer to be employed for varnishes, lacquers, and similar fast-drying materials, as well as various other, more slowly drying materials. Although in the embodiment shown the atomizer is of the pistol type, atomizers in accordance with the present invention may also be operated by a thumb.

Double-acting liquid atomizers hitherto known are generally made so that the pump of the atomizer is inserted into the neck of a liquid container. A lower part of the operating cylinder contains a coil compression spring which constantly urges an operating piston in the cylinder toward one of its terminal positions. The bottom of the operation cylinder is provided with a one-way valve. An upper part of the cylinder has a smaller inner diameter, and forms a minor or inner cylinder which guides a broader part of the piston rod of the operation piston. An upper part of the piston rod is formed as a tapered pin. A jacket of the piston rod is firmly mounted on such pin, and is slidingly disposed in an external body which forms a nut for connecting the atomizer to a liquid container. A lower part of the jacket of the piston rod is shaped into a sealing piston cuff, which has a larger diameter than the diameter of the jacket of the piston rod. When the operation piston is in its upper or forward terminal position, the sealing piston covers a transverse channel which passes through the wall of the minor or inner cylinder. The transverse channel leads to the jacket of the piston rod at one side and into an annular cavity formed between an outer wall of the inner cylinder and an inner wall of the external body of the atomizer at the other side thereof. A lower part of the annular cavity is connected with the container by an axial channel passing through a flange of the operation cylinder and a sealing means.

As long as the operation piston is in its upper or forward terminal position, it does not rest on the sealing front surface of the inner cylinder. To the contrary, a free space for liquid is provided forwardly of the operation piston, and the liquid is forced to a spraying nozzle through a longitudinal slot created in the surfaces of the piston rod and the pin. The liquid is sucked from the container into the operation cylinder by pressing the operation piston rearwardly from its forward or upper terminal position. An underpressure created in the container sucks compensating air from a gap between the surface of the jacket of the piston rod and the inner wall of the external body through the axial channel, the annular cavity, and the transverse channel.

A problem with the above-described prior art atomizer follows from the fact that the transverse channel placed in such manner has to be closed by the sealing piston when the piston is in its forward or upper terminal position. Therefore, the transverse channel is never connected with the longitudinal slot leading to the spray nozzle. Consequently, the spraying nozzle cannot be cleaned by the suction of a residue of liquid from the nozzle back to the container after the spraying operation is finished. Spraying nozzles thus become stuck with liquid residues, and therefore the double-acting mechanical atomizers cannot be used for fast-drying liquids, such as varnishes, lacquers, and the like. No double-acting atomizer hitherto known is capable of operation-tested reliable self-cleaning of the spraying nozzle.

The above disadvantage of the prior art is overcome by the double-acting atomizer of the present invention. In such atomizer, a radial channel is provided in the wall of the inner cylinder, such channel being disposed outside and rearwardly of the sealing piston when the sealing piston is in its upper or forward terminal position, and connecting the spraying nozzle with the space forwardly of the operation piston by means of longitudinal slots in the piston rod of the operation piston.

In a preferred embodiment of the double-acting mechanical spraying device of the invention there is a housing which is adapted to be mounted upon and sealed to the neck of a liquid container. Liquid is fed upwardly from the container into a rear or lower compartment within the housing through a dip tube in the container and a check valve preventing the return of liquid from the liquid-containing compartment in the housing to the container. In the housing, aligned with the liquid-containing compartment, there is an operation cylinder which has an annular valve seat disposed transversely to and intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. The plunger has a plunger rod disposed coaxial thereof and extending forwardly to a driving connection between it and a plunger operating trigger or handle of the spraying device. A coil compression spring constantly urges the plunger toward its forward, valve seat closing position; when pulled rearwardly the handle thrusts the plunger to the rear against the opposition of the spring. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

In the drawing:

The single FIGURE of the drawing is a fragmentary view partially in side elevation and partially in vertical axial section of a preferred embodiment of double-acting mechanical atomizer of the piston type in accordance with the invention, the atomizer being shown mounted upon the neck of a fragmentarily illustrated liquid container.

Although the double-acting mechanical atomizer shown in the drawing and now to be described is of a pistol type, it is to be understood that the atomizer in accordance with the invention can also be made with the pump of the atomizer disposed coaxial of the longitudinal axis of the liquid container, the atomizer being operated by a thumb actuated plunger.

Turning now to the drawing, the double-acting mechanical atomizer shown has a main body 1 having an axially extending circular cylindrical bore 2 therewithin. Means is provided to mount the atomizer upon the neck 5 of a liquid container, such means being in the form of a tube 3 formed integrally with the body 1 and extending rearwardly (to the right) at a slight angle beyond the perpendicular with respect to the axis of the body 1. In the embodiment shown, the member 3 is provided with an external annular flange which engages an annular sealing washer interposed between the bottom surface of the flange and the upper surface of the neck of the container. The member 3 is held upon the container by a threaded connection 4, such connection being formed by external threads on the member 3 below the flange thereon, such external threads mating with internal threads on the upper end of the neck 5 of the container. A tube 6 disposed within and coaxial of the member 3, and formed integrally therewith and with the body 1, has a check valve 7 mounted on the lower end thereof, the lower end of the tubular outer member of the check valve being connected to the upper end of a dip pipe 8 which leads downwardly within the interior of the fragmentarily shown liquid container. The check valve 7 permits the passage of liquid from the container upwardly within the tube 6, but prevents the return of such liquid downwardly into the container.

An operation cylinder 14 is mounted within the bore 2 of the body 1 coaxially thereof and is sealed thereto by a rear O-ring 12 and a forward O-ring 13. After assembly of such parts, the operation cylinder 14 remains stationary with respect to the body 1 of the atomizer. The operation cylinder 14 has a first, rear, circular cylindrical bore **14*a* therewithin, and a second, front, smaller diametered bore 14*b* therein, such bores being coaxial. The junction between the bores 14*a* and 14*b* is in the form of a rearwardly converging frusto-conical or annular wedge-shaped surface 16. Between the forward O-ring 13 and the rear O-ring 12 the forward portion of the operation cylinder 14 is provided with an elongated annular recess, such recess forming an annular cavity 17 with the confronting portion of the wall of the bore 2 in the body 1**.

The body 1 is provided with a forwardly and angularly upwardly directed projection 9 on its upper surface, such projection serving as a support for a pivot pin **9*a* to which the upper end of a control trigger or handle 10 is pivotally connected. An intermediate portion of the trigger 10 is pivotally connected by oppositely directed pivot means, one of which is shown at 26, to a first, radially outer piston 15 in the form of an elongated sleeve. The piston 15 has the rear end thereof slidably mounted within the bore 14*b* of the operation cylinder 14; piston 15 has a diameter of from 0.05 to 0.20 mm less than the diameter of the bore 14*b*. The inner or rear end of the piston 15 is made in the form of a cuff piston 25 opening to the rear which sealingly cooperates with the bore 14*b* and which functions as the movable element of a valve which selectively opens and closes a liquid bleeding hole or opening 20 in the forward portion of operation cylinder 14**.

Within the outer, tubular piston 15 there is mounted the rod of a second, inner piston, such inner piston rod having a forward or left-hand portion **28*a* of circular cylindrical configuration, an intermediate, frusto-conical portion 28*b*, and a rear end portion 28*c* having a circular cylindrical peripheral surface, portion 28*c* of the piston rod having a diameter substantially greater than that of portion 28*a*. Mounted upon the portion 28*c* of the inner piston rod is a cuff piston 31 having a cuff 32 which is open in a forward direction, the radially outer edge of which sealingly cooperates with the rear bore 14*a* of the operation cylinder 14. The cuff piston 31 and the inner piston rod upon which it is mounted are constantly urged forwardly, that is to the left, by a coil compression spring 34 which acts between a spring seat 33 on the rear of the cuff piston 31 and a spring seat on the rear end of the body 1** of the atomizer.

A spraying nozzle is provided on the outer, left-hand end of the portion **28*a* of the inner piston rod and the outer, left-hand end of the outer tubular piston 15. With the parts in the positions thereof shown in the drawing, the left-hand end surfaces of such pistons lie in a common transverse plane. The nozzle 24 is made up of an annular member having a circular cylindrical tubular portion telescoped over the outer end of piston 15 and a frusto-conical portion converging to the left as shown. A central axially directed spray aperture 27 is formed in the end portion of the nozzle 24. Liquid under pressure is fed to the interior of the nozzle member and thence outwardly through the spray opening 27 by means of at least one axially extending groove in the outer surface (two shown at 29 and 30) of the portion 28*a* of the inner piston rod. Such liquid under pressure is supplied to grooves 29 and 30 and thence to the spray nozzle 24 by the action of the cuff piston 31 when such piston moves to the left under the thrust exerted upon it by the coil compression spring 34, and by the cuff 25 of the outer piston 15 when such outer piston 15 is thrust to the rear by the counter-clockwise swinging of the handle or trigger 10 acting through the pivot means 26**.

Upon the forward stroke of the cuff piston 31, liquid is sucked upwardly from the container through the dip pipe 8 to the check valve 7, upwardly through a transverse annular passage 18, into the conduit means 6 through a passage 19 formed as a groove in the portion **14*a* of the cylinder 14, and thence radially inwardly through the passage 21. Liquid thus fills the chamber S in the atomizer, which contains the spring 34, at the rear end thereof. It is this body of liquid which is dispensed in both the oppositely directed strokes of the apparatus as the trigger or handle 10** is oscillated.

The radially inner and outer piston rods move together as a unit with a small endwise play between them to the rear when the handle or trigger member 10 is rotated counterclockwise, since the left-hand end of the inner piston rod is then engaged by the inner end surface of the spray nozzle 24, whereby in the initial part of such rearward stroke the cuff sealing piston 25 soon travels to and seals the radial opening or hole 20 in the wall of portion **14*b* of operation cylinder 14, thus permitting the liquid in the chamber at the rear of the member 1 to be transmitted through the grooves 29 and 30 to the nozzle 27 under pressure. When the handle or trigger 10 is released and the coil compression spring 34 thrusts the cuff piston 31 to the left, such piston thrusts the liquid in the chamber which is disposed forwardly of piston 31 to the left under pressure through the grooves 29, 30 to the spray nozzle. Such discharge under pressure continues until the outer tubular piston rod 15 moves to the left sufficiently for the sealing cuff 25 thereon to uncover the radial hole 20 so that the remainder of the liquid, which would otherwise be forwarded to the spray nozzle, is now bled through the hole 20 into the annular space 17 and thence through a radial hole 22 in the member 1 which drains the liquid in space 17 downwardly into a passage 23 in member 3** which leads such liquid back into the liquid container.

Manner of Operation

The spring 34 presses the cuff 32 of the piston 31 to the left into the rest position thereof shown in the drawing, that is, into the wedge recess 16. The transition part **28*b* of the inner piston rod and thus also the longitudinal grooves 29, 30 and the spray nozzle 27 are connected with the space within the liquid container through the transverse channels 22 and 20. Assuming that all spaces between the right-hand end of the piston 31 and the one-way valve 7 are filled with liquid from a preceding operation, the liquid starts to flow, by pushing the control handle or trigger 10 to the right to thrust the operation piston 31, the cuff 32 of which acts as a one-way valve, into the space forwardly of the operation piston 31 and for a first short moment, the liquid then flows through the longitudinal channels 29, 30 and the transverse channels 20 and 22 back into the liquid container. After the valve made up of the cuff 25 on the outer piston rod 15 and the channel or passage 20 closes, that is, after the cuff 25 covers channel 20, all of the liquid now flows to the left in the longitudinal grooves 29, 30 toward the spraying nozzle 27. Air is sucked into the container through the clearance between the outer piston rod 15 and bar 14*b* and entrains a contingent leaking liquid through the transverse channel 22** back into the container.

If the control trigger or handle 10 is then released, the spring 34 pushes the operation piston 31 to the left to the wedge recess 16, and the liquid is forced out from the portion of space S disposed forwardly of the operation piston 31 through the same longitudinal channels or grooves 29, 30 into the spraying nozzle 27. A virtually continuous cloud of the atomized liquid is formed by the repeated pushing and releasing of the handle or trigger 10.

A feature of the described arrangement is the provision of a liquid seal between the inner and outer piston 28, 15 during the operation of the atomizer. This always lets enough air into the atomizer for a reliable operation thereof, but does not allow a fast and complete equalizing of the inner and outer pressure of the air. After the spray operation has been completed, the control handle or trigger 10 is completely released, and a residual underpressure in the container is equalized with the atmospheric pressure through the spraying nozzle 27, whereby liquid from the spraying nozzle is sucked through the longitudinal grooves 29 and 30 and the transverse channel 22 and the hole 20 back into the container 5.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. Double-acting mechanical liquid spraying device comprising a housing which is adapted to be mounted upon and sealed to the neck of a liquid container, a liquid compartment in the housing, and an operation cylinder in the housing, a liquid pumping plunger disposed in said cylinder and being driven to reciprocate in forward and reverse strokes to dispense liquid from said cylinder, a spray nozzle on the housing, a liquid conducting passage between the plunger and the spray nozzle, and a relief valve having a seat with an opening therethrough and a relief passage to bleed liquid back to the liquid container and to allow atmospheric air to be drawn in through the spray nozzle at the end of the reverse stroke of the plunger, thereby to clear the spray nozzle of liquid at the end of each pumping cycle consisting of a forward stroke and a reverse stroke, the operation cylinder being aligned with said liquid-containing compartment and having an annular valve seat disposed transversely to and intermediate to the length of the cylinder, the liquid pumping plunger being disposed within said cylinder and being of the cuff type which cooperates with the relief valve seat to close the opening through the seat when the plunger is in its forward terminal position, the plunger having a plunger rod disposed coaxial thereof and extending forwardly through the operation cylinder to a driving connection between the plunger rod and a plunger operating handle on the spraying device, the operation cylinder having a side wall, the relief valve is in the form of a sleeve surrounding the plunger rod and slidable in the operation cylinder, the relief passage being constituted by at least one radial opening through the side wall of the operation cylinder forwardly of the liquid-containing compartment, the sleeve having a rear edge, said rear edge on the sleeve forming the relief valve being disposed forwardly of the relief passage when the operating handle is released and covering the relief passage only after a short rearward movement of the sleeve forming a part of the relief valve.

2. A liquid spraying device according to claim 1, comprising a coil compression spring constantly urging the plunger toward its forward, valve seat closing position, wherein when pulled rearwardly, the handle thrusts the plunger to the rear against the opposition of the plunger, during its spraying operation.

3. A double-acting liquid spraying device comprising:

a housing having an operation cylinder which is connected through a passage to a container of liquid, the said operation cylinder having a space arranged above the said passage connecting the container of liquid to the operation cylinder, and adjacent to said space in the operation cylinder is slidingly disposed a sealing piston mounted on a piston rod topped with a cuff, the sleeves of which are directed to a nozzle mounted on the other end of the said piston rod, and also inside the said operation cylinder space there is slidingly disposed an operation piston which is set in one stationary position by a coil compression spring, wherein said operation piston can be moved in the opposite direction by movement of a trigger which acts through a pivot means, along the surface of said piston rod is at least one longitudinal groove, said groove connecting the said space in the operation cylinder, which contains liquid brought from the container by said passage, to a spraying nozzle, wherein when said trigger moves the piston, liquid in the said space enters the groove and is then pushed out toward the spraying nozzle by the compression closure of the operation piston by the coil compression spring after the trigger is released, and said liquid is pushed out of the nozzle until the cuff of the piston rod seals the passage and forces the remaining liquid back through an annular space formed on the outer surface of said operation cylinder, said annular space being adapted to be connected with said liquid container and with a radial channel in the wall of said operation cylinder, the said radial channel being placed outside the said sealing piston, the pump being so constructed and arranged that when said sealing piston is in its upper dead center position, the radial channel is connected through the longitudinal groove with said spraying nozzle so that the remainder of the liquid, which would otherwise be forwarded to the spray nozzle by the longitudinal groove, is now bled through a second annular space and into a second radial channel which allows the unused liquid to flow into a second passage leading to the liquid container, thereby providing a ventilating system for the liquid container, and at the same time a clearing system for the nozzle.

4. A double-acting mechanical pump having an external hollow body within which there is an insert having two hollow parts, one of said parts being an operation cylinder, the other said part being a minor cylinder with a smaller inner diameter than that of the operation cylinder, inside the said minor cylinder being disposed a piston rod provided on one end with an operation piston having a cuff the sleeves of which are directed to the nozzle mounted on the other end of the said piston rod, the surface of which is provided with at least one longitudinal slot, connecting a space adjacent to the said nozzle with the space above the said operation piston, said surface of the piston rod being coated with a jacket terminated with a sealing piston topped with a cuff directed to the said operation cylinder being placed outside the said sealing piston when said sealing piston is in its upper dead position creating thus a connection of the said longitudinal slot with an annular space formed on the outer surface of the said minor cylinder, said annular space being connected through a radial channel in the wall of the hollow body of the pump with a liquid container forming thus a venting system for the liquid container and at the same time a clearing system for the nozzle, said operation cylinder containing a coil compression spring for pushing the operation piston in one direction and containing at the bottom a radial channel for a connection through a channel in the outer wall of the operation cylinder with a one-way valve leading to the liquid container.

* * * * *